US010367316B2

(12) United States Patent
Zhu

(10) Patent No.: US 10,367,316 B2
(45) **Date of Patent: *Jul. 30, 2019**

(54) CONNECTING ROD

(71) Applicant: Gong Zhu, Xiamen (CN)

(72) Inventor: Gong Zhu, Xiamen (CN)

( * ) Notice: Subject to any disclaimer, the term of this patent is extended or adjusted under 35 U.S.C. 154(b) by 69 days.

This patent is subject to a terminal disclaimer.

(21) Appl. No.: 15/920,472

(22) Filed: Mar. 14, 2018

(65) Prior Publication Data

US 2018/0212382 A1 Jul. 26, 2018

Related U.S. Application Data

(63) Continuation of application No. 15/602,146, filed on May 23, 2017, now Pat. No. 9,979,148.

(30) Foreign Application Priority Data

May 24, 2016 (CN) ..... 2016 1 0352013

(51) Int. Cl.

| | |
|---|---|
| ***H01R 25/16*** | (2006.01) |
| ***H01R 4/42*** | (2006.01) |
| ***H01R 4/00*** | (2006.01) |
| ***H01R 4/62*** | (2006.01) |
| ***H01F 27/29*** | (2006.01) |
| ***H01R 25/14*** | (2006.01) |
| *H01R 4/36* | (2006.01) |
| *H01R 11/28* | (2006.01) |

(52) U.S. Cl.

CPC ..... *H01R 25/162* (2013.01); *H01F 27/29* (2013.01); *H01R 4/42* (2013.01); *H01R 4/54* (2013.01); *H01R 4/62* (2013.01); *H01R 25/145* (2013.01); *H01R 4/36* (2013.01); *H01R 11/28* (2013.01)

(58) Field of Classification Search

CPC .... H01R 4/4863; H01R 4/489; H01R 4/5008; H01R 11/281; H01R 11/282; H01F 27/02; H01F 27/263

USPC ..... 336/192; 361/212, 213

See application file for complete search history.

(56) References Cited

U.S. PATENT DOCUMENTS

2012/0154094 A1* 6/2012 Goertz ..... H01F 27/29 336/192

2017/0321338 A1* 11/2017 Von Kaenel ..... C25C 7/025

* cited by examiner

*Primary Examiner* — Hien D Vu

(57) ABSTRACT

The invention relates to an electric device, especially to a connecting rod, said connecting rod comprises a conductive first column portion that has an interference fit with a busbar, said first column portion axially arranges a conductive second column portion which has an interference fit with said first column portion, said second column portion is located inside of said first column portion, a thermal expansion coefficient of said second column portion is greater than that of said first column portion. Said transformer has such advantageous effects, 1. the same overlapping length increases more conductive surface for reducing a current density to achieve low temperature rising of connecting part; 2. amount of material is reduced and save the social source; 3. the electric clearance or safety distance is increased, an electric safety of device is also increased; 4. a width of a connecting part is reduced, an occupation space of transformer is also reduced.

2 Claims, 6 Drawing Sheets

CONNECTING ROD

RELATED APPLICATIONS

This application is a continuation of U.S. patent application Ser. No. 15/602,146, filed May 23, 2017, which claimed priority to China Patent Application No. 2016103520134, filed May 24, 2016, the entire content of related applications is hereby incorporated by reference.

FIELD OF THE INVENTION

The invention relates to an electric device, especially to an output of a low-voltage-side of a transformer.

DESCRIPTION OF PRIOR ART

In the field of power distribution, usually, an output of a low-voltage-side of a transformer is directly connected with a busbar, partly overlapping an output and a busbar is usually used to be a manner of a connection between a transformer and a busbar, then using bolts and nuts to fasten them. See the upper half of FIG. 8, as this manner required, there is a certain length of a busbar and an output needed to overlap for keeping a current density of a touching surface within a normal range of values so as to make the connecting part meet requirements of related standards. In order to keep a low temperature rising of an electric device, usually a length of overlapping is increased for increasing a touching surface so as to reduce a current density thereof. However, increasing the length of overlapping may increase amounts of busbars resulted in increasing cost. Electric clearance or phase distance between busbars may be reduced as a result of bolts used for fastening, in order not to reduce the electric clearance or phase distance, a distance between an output and a nonconductive elements needs to be increased, however increasing the distance necessarily enlarge an occupation space of a transformer.

How to increase a touching surface for reducing a temperature rising not resulted in reducing electric clearance or enlarging occupation space of a transformer.

SUMMARY OF THE PRESENT INVENTION

The object of the invention is to provide an output of a low-voltage-side of a transformer so as to solve the above problem.

Such object is achieved by providing an output of a low-voltage-side of a transformer as defined in claim 1. Further advantageous according to the invention will be apparent from the dependent claims.

The invention provides an output of a low-voltage-side of a transformer, said output comprises a clamping portion for clamping a low-voltage binding post and a connecting portion for connecting with a busbar, said clamping portion is formed integrally with said connecting portion. Said connecting portion comprises a connecting rod, which partly inserts into said connecting portion and has an interference fit with said connecting portion, said connecting rod comprises a conductive first column portion that has an interference fit with a busbar, said first column portion axially arranges a conductive second column portion which has an interference fit with said first column portion, said second column portion is located inside of said first column portion, a thermal expansion coefficient of said second column portion is greater than that of said first column portion.

Advantageously, a resistivity of said second column portion is greater than that of said first column portion.

Advantageously, a material of said second column portion is an aluminum or an aluminum alloy, and a material of said first column portion is a copper or a copper alloy.

Advantageously, a ratio of an outer diameter of said second column portion to said first column portion is between 0.5 and 0.8.

Advantageously, said second column portion has a solid structure, and said first column portion has a hollow structure, said first column portion is penetrated by said second column portion.

Advantageously, said connecting rod axially arranges a second through hole located inside of said connecting rod, a first through hole is radially arranged to an outer cylindrical surface of said connecting rod, said first through hole is communicated with said second through hole, said first through hole is located at a middle portion of said connecting rod with respect to an axial direction.

Advantageous Effects

Since a connecting portion of an output of a low-voltage-side of a transformer is connected to a busbar via a manner of butt-and-butt connecting, such connecting manner have following advantageous effects compared to a usual manner of overlapping connecting.

1. The same overlapping length with respect to the prior art increases more conductive surface for reducing a current density to achieve low temperature rising of connecting part.
2. No need to overlap a busbar and an output, so amount of material is reduced and save the social source.
3. Because there is no bolts or nuts for fastening, the electric clearance or safety distance is increased, an electric safety of device is also increased.
4. Because there is no bolts or nuts for fastening, a width of connecting part is reduced, an occupation space of a transformer is also reduced.

BRIEF DESCRIPTION OF THE DRAWING

Further characteristics and advantages of the invention will emerge from the description of preferred, but not exclusive embodiments of the output according to the invention, non-limiting examples of which are provided in the attached drawings, in which.

LIST OF REFERENCE SYMBOLS

1. first column portion;
2. second column portion;
3. front surface;
4. rear surface;
5. end surface;
6. first through hole;
7. second through hole;
8. clamping portion;
9. connecting portion.

DETAILED DESCRIPTION OF THE PREFERRED EMBODIMENT

R in this application stands for a radius.

Embodiment 1

Figure 6:
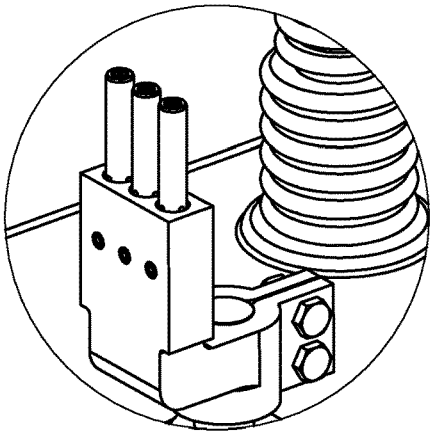
FIG. 6 is a zoom in drawing of part C in FIG. 5.
Figure 15:
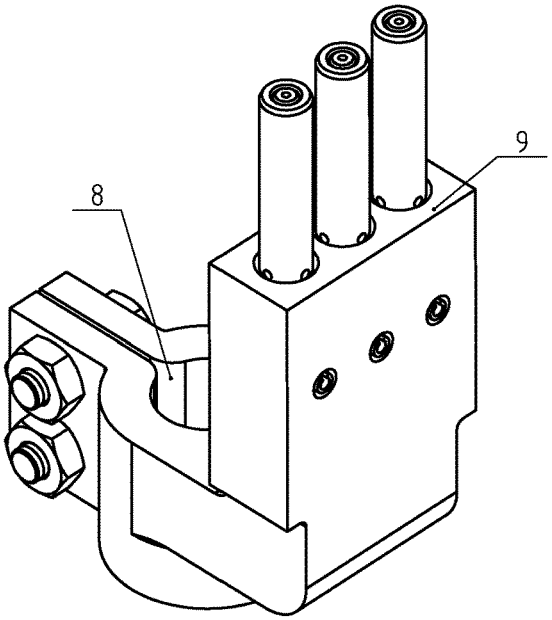
FIG. 15 is a 3d-drawing of an output of a low-voltage-side of a transformer of the invention.

Referring to FIG. 6 and FIG. 15, it shows an output of a low-voltage-side of a transformer of the invention, said output comprises a clamping portion 8 for clamping a low-voltage binding post and a connecting portion 9 for connecting with a busbar, said clamping portion 8 is formed integrally with said connecting portion 9. Said connecting portion 9 comprises a connecting rod, which partly inserts into said connecting portion 9 and has an interference fit with said connecting portion 9, an inserting length is about half of a length of said connecting rod, lower half of said connecting rod inserts into said connecting portion 9, said connecting rod and said connecting portion 9 are tightly connected together by a pin of a front surface of said connecting portion 9.

Figure 5:
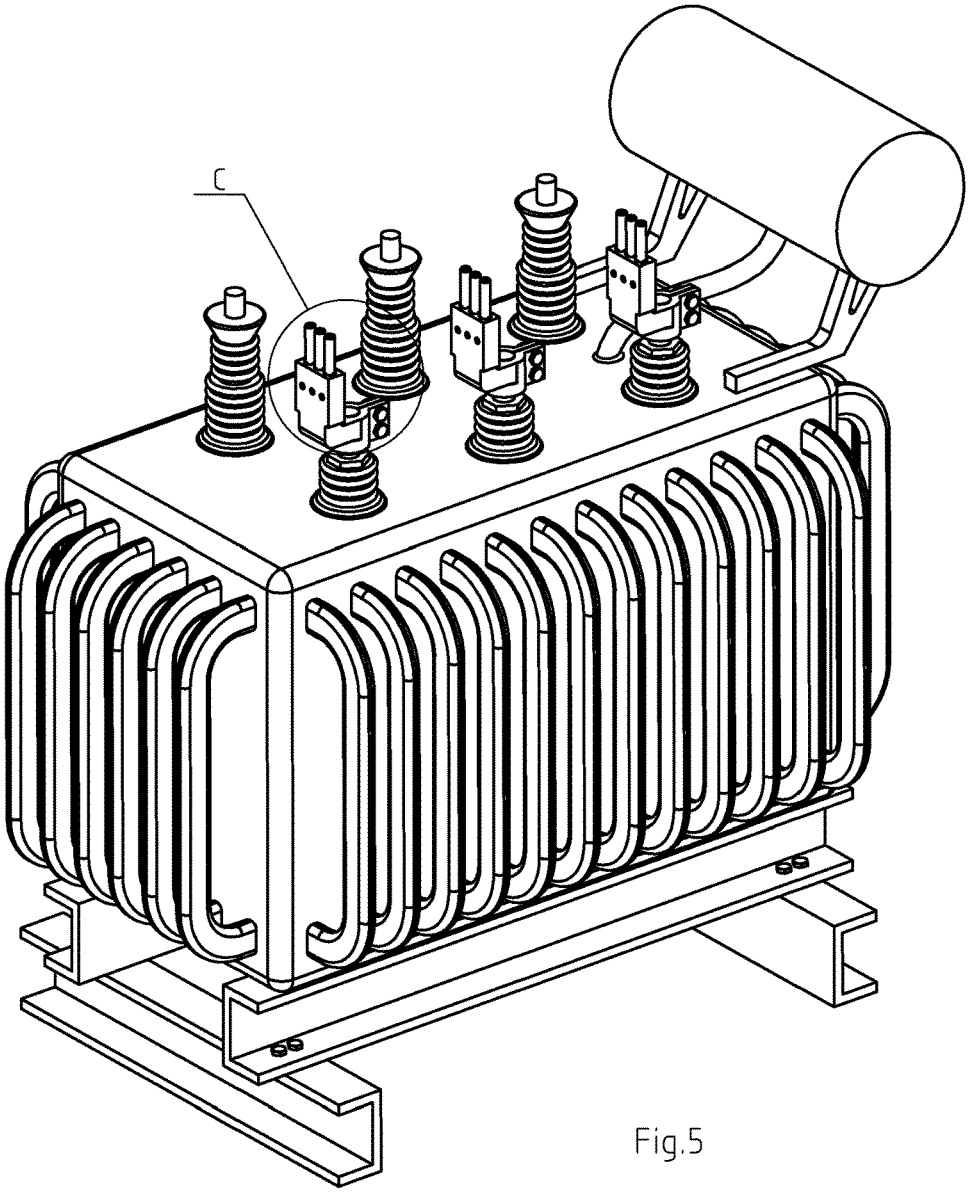
FIG. 5 is a 3d-drawing of an output applied to a transformer.

Referring to FIG. 5, it shows an output of the invention applied to a transformer, said clamping portion 8 clamps a low-voltage binding post of a transformer, then use bolts and nuts to fasten said clamping portion 8 with a low-voltage binding post of a transformer.

Figure 3:
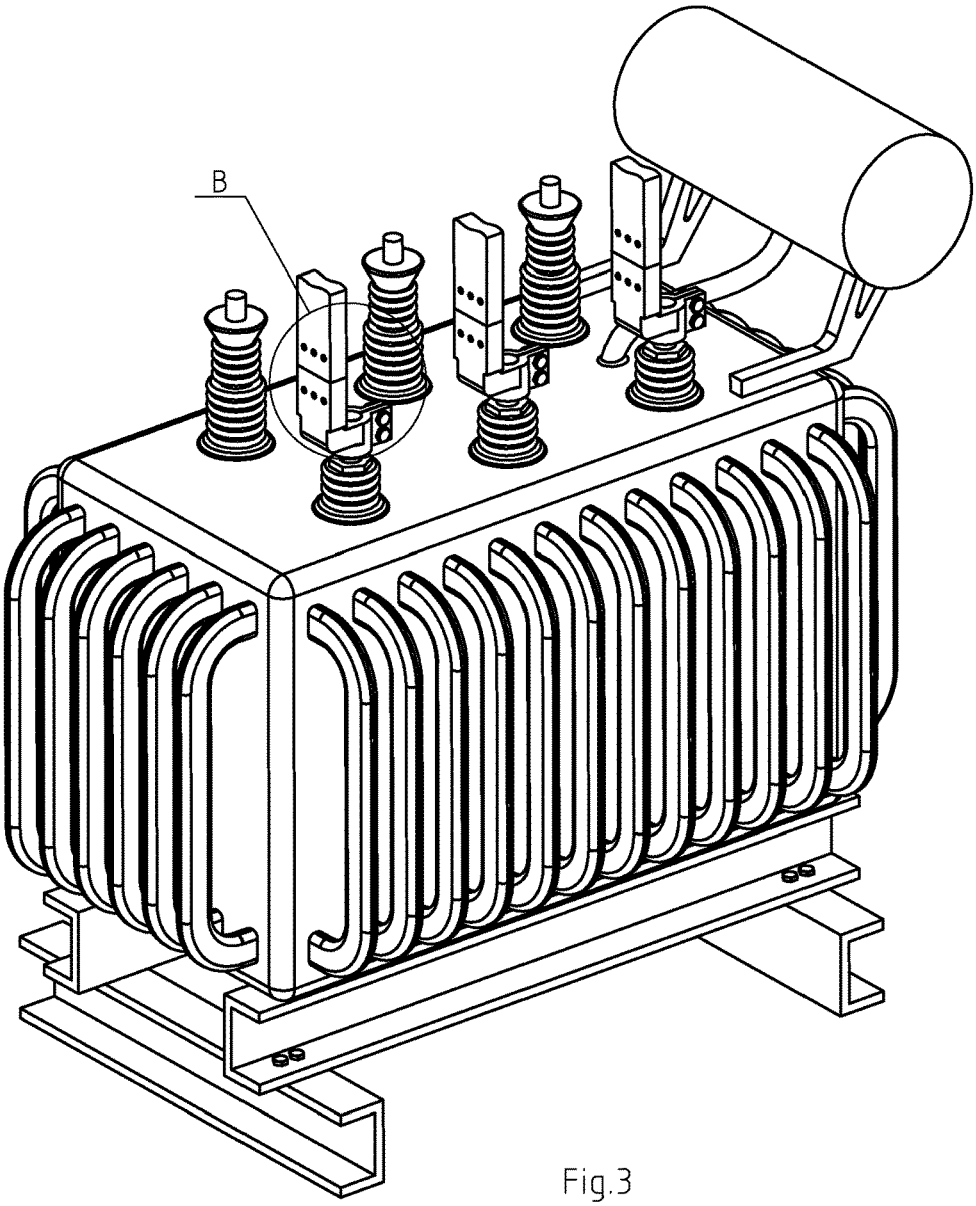
FIG. 3 is a 3d-drawing of a transformer of the invention, wherein a busbar is already assembled by a manner of butt-and-butt connecting.
Figure 4:
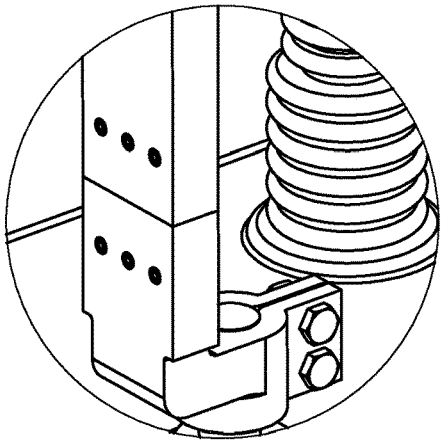
FIG. 4 is a zoom in drawing of part B in FIG. 3.

Referring to FIG. 3-4, said connecting rod of said connecting portion 9 inserts into a pre-hole of a busbar, there is an interference fit between a busbar and said connecting rod, an end surface 5 of a busbar fits with an end surface of said connecting portion 9, said connecting rod and a busbar are tightly connected together by a pin of a front surface 3 of a busbar, such connecting manner is called butt-and-butt connecting, as FIG. 4 shows.

Figure 1:
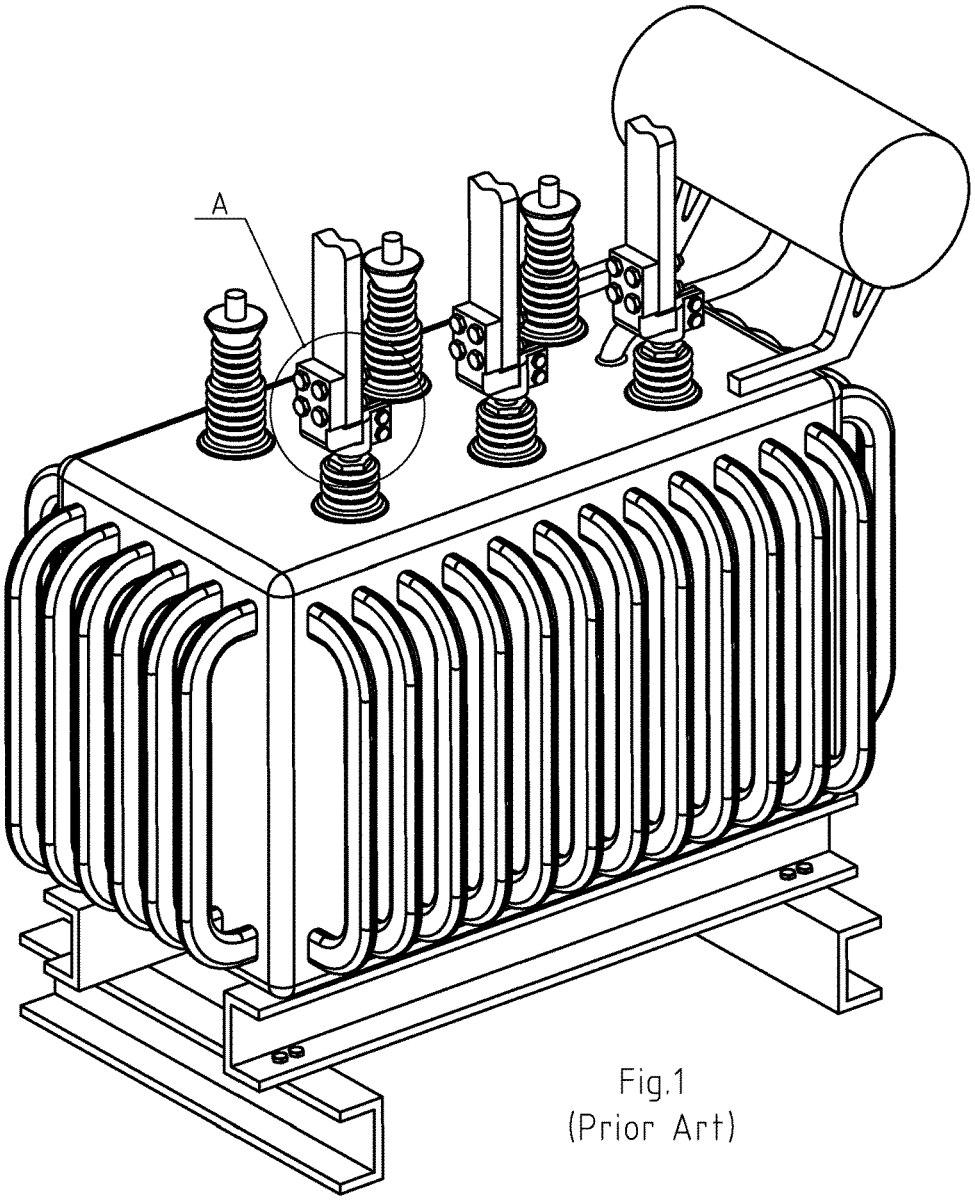
Fig.1 (Prior Art)
FIG. 1 is a 3d-drawing of a traditional transformer, wherein a busbar is already assembled by a usual connecting manner.
Figure 2:
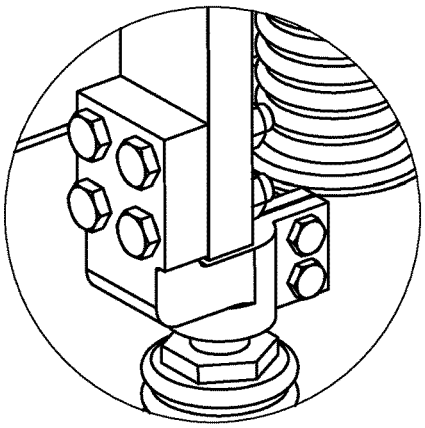
Fig.2 (Prior Art)
FIG. 2 is a zoom in drawing of part A in FIG. 1.

Referring to FIG. 1, it shows a usual connecting manner between a traditional output of a transformer and a busbar, partly overlapping an output and a busbar and then fastening them via bolts and nuts, such connecting manner is called overlapping connecting, as FIG. 2 shows.

Figure 8:
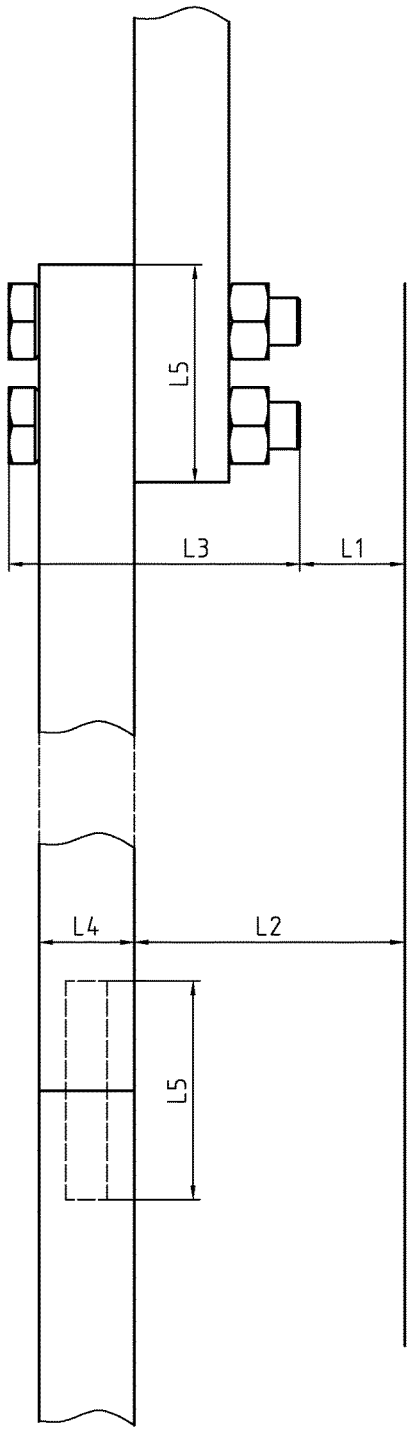
Fig.8 (Prior Art)
FIG. 8 is a contrast drawing of two kinds of connecting manners between the prior art and the invention.

Referring to FIG. 8, it is a contrast drawing of two connecting manners, upper half of the drawing shows an overlapping connecting between an traditional connecting portion of an output of a transformer and a busbar, lower half of the drawing shows a butt-and-butt connecting between a connecting portion 9 of an output of the invention and a busbar, a solid line on the right of the drawing is an auxiliary line for calculating an electric clearance or a safety distance. In order to highlight different effects between these two manners, the manner of the invention is directly arranged below the usual manner, each manner has the same touching length L5. As to the usual manner, L5 is a length of overlapping busbars, as to the invention, L5 is a length of a connecting rod. Intuitive differences between these two connecting manners are differences of relative dimensions, L1 is an electric clearance or safety distance of the usual manner, L2 is an electric clearance or safety distance of the invention, L3 is a width of connecting part of the usual manner, L4 is a width of connecting part of the invention.

Obviously, L2 is greater than L1, increasing amount is about a thickness of a busbar plus a rising height that a tail portion of bolt rises from a nut and plus a height of a nut. Obviously, L4 is lesser than L3, reducing amount is about a thickness of a busbar plus a height of head of a bolt plus a height of a nut and plus a rising height that a tail portion of bolt rises from a nut. Therefore, favorable factors (such as electric clearance or safety distance) for power device are increased, while unfavorable factors (such as occupation space) for power device are reduced.

Figure 9:
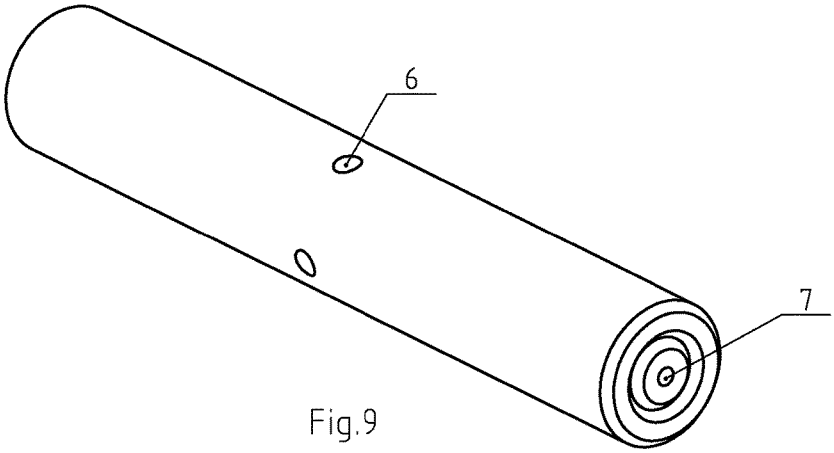
FIG. 9 is a 3d-drawing of a connecting rod of the invention.

Referring to FIG. 9, it is a connecting rod of the invention, said connecting rod has a column shape, and has a chamfer located at an end portion thereof convenient for assembling.

Figure 10:
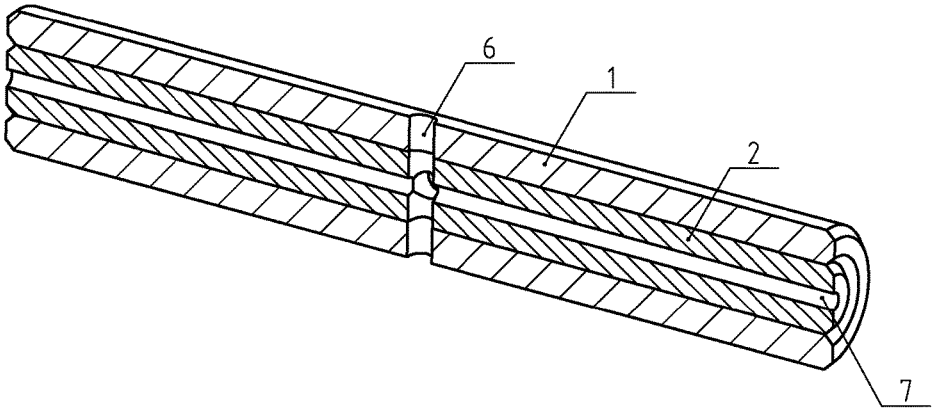
FIG. 10 is a sectional 3d-drawing of FIG. 9.

Referring to FIG. 10, a first column portion 1 axially arranges a second column portion 2 which has an interference fit with said first column portion 1, said second column portion 2 is located inside of said first column portion 1. A material of said first column portion is a copper, and a material of said second column portion 2 is an aluminum.

Figure 11:
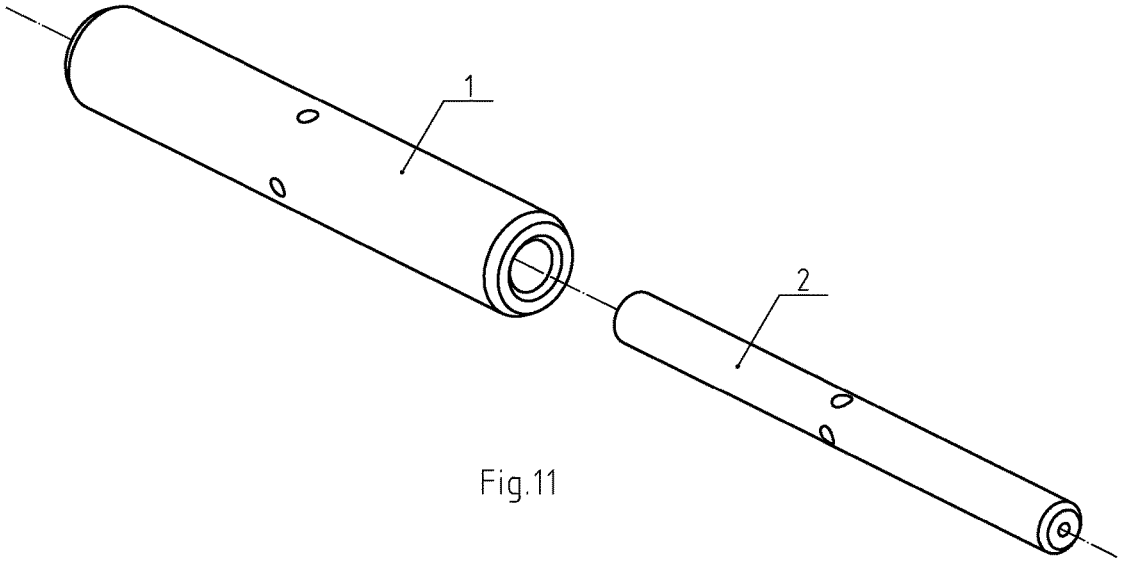
FIG. 11 is an exploded 3d-drawing of FIG. 9.

Referring to FIG. 11, said second column portion 2 has a solid structure, and said first column portion 1 has a hollow structure, said first column portion 1 is penetrated by said second column portion 2. A ratio of an outer diameter of said second column portion 2 to said first column portion 1 is between 0.5 and 0.8. Said first 1 and second 2 column portion are conductive, a thermal expansion coefficient of said second column portion 2 is greater than that of said first column portion 1, a resistivity of said second column portion 2 is greater than that of said first column portion 1.

After said connecting rod is assembled to said connecting portion 9 and a busbar, because there is an interference fit between said first column portion 1 and a pre-hole of said connecting portion 9 and of a busbar, said first column portion 1 fits closely together with said connecting portion 9 and a busbar so as to fully carry current. Because there is an interference fit between said first column portion 1 and said second column portion 2, they fit closely together with each other, said second column portion 2 also fully carries current. Therefore, thermal effect of said first 1 and second 2 column portion works well, a temperature of said second column portion 2 is greater than that of said first column portion 1, since a resistivity of said second column portion 2 is greater than that of said first column portion 1. Radial swelling of said second column portion 2 is obviously greater than that of said first column portion 1 under a condition that temperature and thermal expansion coefficient are relatively greater, since a thermal expansion coefficient of said second column portion 2 is greater than that of said first column portion 1. Therefore, said second column portion 2 fits closely together with said first column portion 1 and radially exerts an outwards force on said first column portion 1 so as to enlarge a radial dimension of said first column portion 1, finally said first column portion 1 fits more closely together with said pre-hole of said connecting portion 9 and of a busbar and simultaneously exerts a radially outwards force on said pre-hole, that is to say a pressure between said connecting rod and said connecting portion 9 and a busbar is greater now than when they begin to be assembled together, an increasing pressure thereof is good to reduce a temperature rising on a touching surface.

Thus, interference fit between elements, arrangement of resistivity and arrangement of thermal expansion coefficient are great good to reduce temperature rising on a joint of said connecting portion 9 and a busbar, these three mutually effect one another. Initial interference fit is a foundation for effects of resistivity and thermal expansion coefficient, and effects of resistivity and thermal expansion coefficient intensify said interference fit, finally a contact pressure of connecting part is enlarged.

Figure 12:
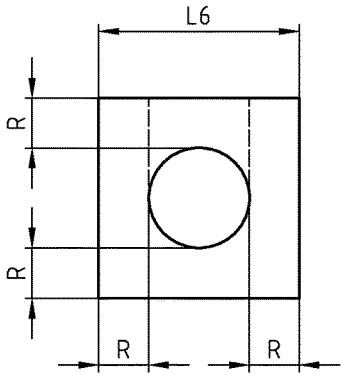
FIG. 12-13 are drawings of an arrangement of connecting rods of the invention.

Referring to FIG. 12, a busbar with a square section has one pre-hole for receiving said connecting rod in a middle portion thereof, a distance from a periphery of said pre-hole to an edge of said busbar is R, a width of said busbar is L6.

As to a manner of overlapping busbars, a conductive area of connecting part is $$S1=L6\times L5=(R+2R+R)\times L5=4R\times L5$$

As to a manner of using connecting rod, a conductive area of connecting part is $$S2=2\pi R\times L5$$

So, $$S2:S1=2\pi R:4R=\pi/2\approx 1.57$$

Therefore, using connecting rod can reach more conductive area, obviously, under a condition of meeting requirement of mechanical strength, increasing a diameter of said pre-hole and reducing a distance from periphery of said pre-hole to an edge of said busbar or of said output can reach much more conductive area.

Figure 13:
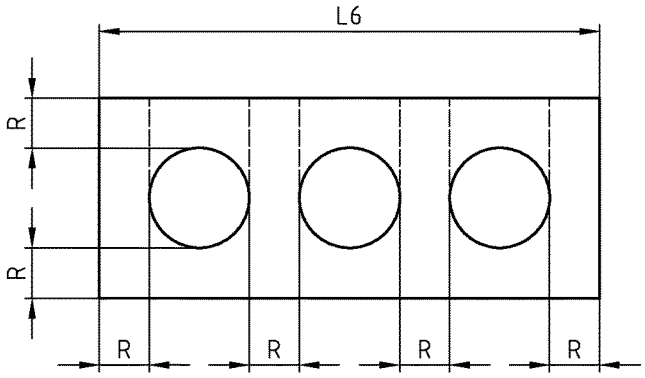

Referring to FIG. 13, a busbar with a rectangle section has three pre-holes for receiving said connecting rods in a middle portion thereof, a distance from a periphery of said pre-hole to an edge of said busbar is R, a minimum distance between neighboring pre-holes is R, a width of said busbar is L6.

As to a manner of overlapping busbars, a conductive area of connecting part is $$S1=L6\times L5=(4R+3\times 2R)\times L5=10R\times L5$$

As to a manner of using connecting rod, a conductive area of connecting part is $$S2=3\times 2\pi R\times L5=6\pi R\times L5$$

So, $$S2:S1=6\pi R:10R=3\pi/5\approx 1.884$$

Therefore, using connecting rod can reach more conductive area, obviously, under a condition of meeting requirement of mechanical strength, increasing a diameter of said pre-hole and reducing a distance from periphery of said pre-hole to an edge of said busbar or of said output can reach much more conductive area.

So said connecting rod of the invention has two positive effects, one is increasing a contact pressure, the other is greatly increasing a conductive area, reducing temperature rising on connecting parts benefits from these two positive effects, the aim of the invention is achieved.

Figure 7:
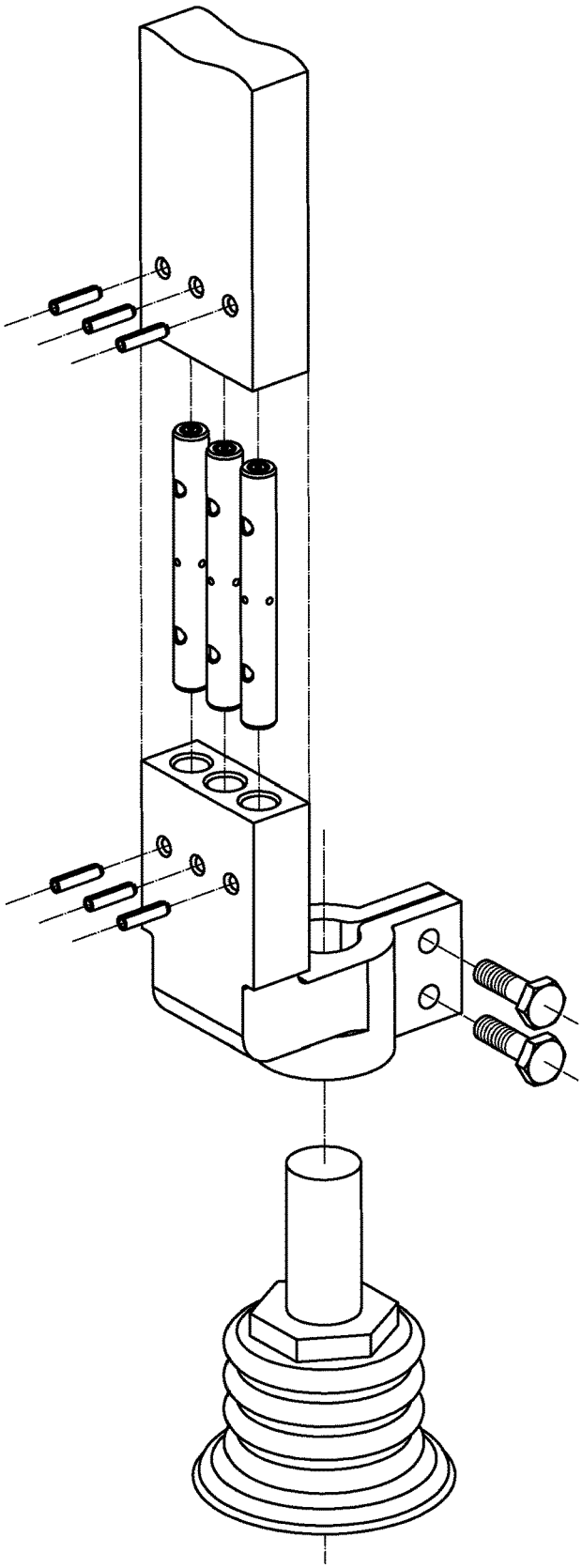
FIG. 7 is an exploded 3d-drawing of part B in FIG. 3.

Referring to FIG. 7, it shows an output of the invention applied to a transformer, a clamping portion 8 of said output clamps a binding post of a low-voltage-side of a transformer, then use bolts and nuts to fasten said clamping portion 8 with said low-voltage binding post. Said connecting portion 9 comprises a connecting rod, which partly inserts into said connecting portion 9 and which has an interference fit with said connecting portion 9, an inserting length is half length of said connecting rod, lower half of said connecting rod inserts into said connecting portion 9, a pin located on a front surface 3 of said connecting portion 9 tightly connects said connecting rod with said connecting portion 9.

Three pre-holes for receiving said connecting rod are made to an end surface 5 of said connecting portion 9 along a length direction of said connecting portion 9 before said connecting rod is assembled to said connecting portion 9, a diameter of said pre-hole is slightly lesser than an outer diameter of said connecting rod so as to achieve a radial interference fit between said connecting rod and said pre-hole, a depth of said pre-hole is slightly greater than half of length of said connecting rod. After said pre-hole is made, half of said connecting rod inserts into said pre-hole wherein a first through hole 6 located at a middle portion of said connecting rod reaches to an end surface 5 of said connecting portion 9, a through hole for assembling a pin is made from a front surface 3 of said connecting portion 9, said through hole penetrates through said front surface 3 and a rear surface 4 of said connecting portion 9, and also penetrates through said connecting rod, an axis of said through hole intersects an axis of said connecting rod, said connecting portion 9 and said connecting rod are tightly connected together by said pin.

Three pre-holes for receiving said connecting rod are made to an end surface 5 of a busbar along a length direction of a busbar before a busbar is assembled to said connecting portion 9, a diameter of said pre-hole is slightly lesser than an outer diameter of said connecting rod so as to achieve a radial interference fit between said connecting rod and said pre-hole, a depth of said pre-hole is slightly greater than half of length of said connecting rod. After a pre-hole is made on a busbar, said pre-hole of a busbar sheathes on said connecting rod rising on said connecting portion 9 till an end surface 5 of a busbar fits with an end surface 5 of said connecting portion 9, then a through hole for assembling a pin is made from a front surface 3 of a busbar, said through hole penetrates through said front surface 3 and a rear surface 4 of a busbar, and also penetrates through said connecting rod, an axis of said through hole intersects an axis of said connecting rod, a busbar and said connecting rod are tightly connected together by said pin to finally achieve that a busbar and said connecting portion 9 are tightly connected together.

After said connecting portion 9 and a busbar are butt-and-butt connected, there is an axial clearance fit between said connecting rod and said pre-hole, this is good for fitting between end surface of said connecting portion 9 and end surface of a busbar. There is a chamfer convenient for assembling located at a head portion of a pre-hole. There is an interference fit between said pin and said hole. An axial movement between said connecting portion 9 and a busbar is limited after said pin is positioned, finally said connecting portion 9, said connecting rod, said busbar and said pin these four are be tightly connected together.

Figure 14:
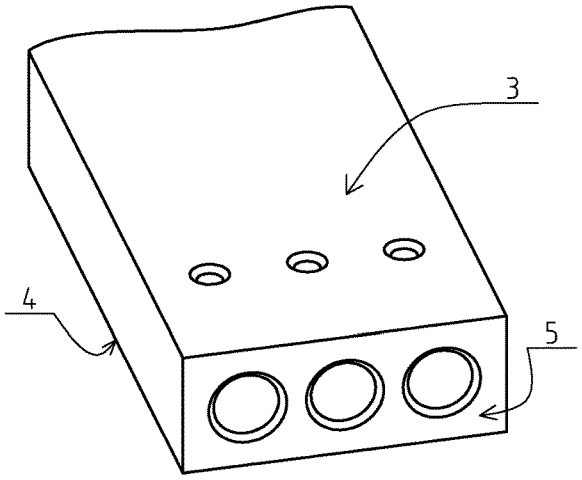
FIG. 14 is a 3d-drawing of a busbar.

Referring to FIG. 14, in order to define surfaces of a busbar and a connecting portion 9, said end surface 5 is defined by a surface bounded by a thickness and a width of a busbar (or a connecting portion 9), as showed as symbol 5 in FIG. 14. A front surface 3 and rear surface 4 are defined by a surface bounded by a width and length of a busbar (or a connecting portion 9), as showed as symbol 3,4 in FIG. 14, symbol 3 is for said front surface, and symbol 4 is for said rear surface.

Referring to FIG. 10, said second column portion 2 axially arranges a second through hole 7 located inside of said second column portion 2, said first column portion 1 has a hollow structure, said first column portion 1 is penetrated by said second column portion 2, a first through hole 6 is radially arranged to an outer cylindrical surface of said first column portion 1, said first through hole 6 is communicated with said second through hole 7, said first through hole 6 is located at a middle portion of said first column portion 1 with respect to an axial direction.

Air in said pre-hole of said connecting portion 9 freely flows out via said second through hole 7 due to such arrangement of through hole 6,7 during said connecting rod inserts into said pre-hole of said connecting portion 9, so said connecting rod is conveniently positioned. Air in said pre-hole of a busbar freely flows out from said first through hole 6 via said second through hole 7 due to such arrangement of through hole 6,7 during a busbar is assembled to said connecting rod that is already assembled to said first busbar, so a busbar is conveniently positioned Embodiment 2

Said material of said first column portion 1 in embodiment 1 is replaced by a copper alloy, and said material of said second column portion 2 in embodiment 1 is replaced by an aluminum alloy. Since a hardness of alloy is relatively high, said second column portion 2 is kept in a low temperature (5° C.) for a period of time (5 minutes), and said first column portion 1 is kept in a high temperature (80° C.) for a period of time (5 minutes), an inner diameter of said first column portion 1 is slightly increased and an outer diameter of said second column portion 2 is slightly reduced due to thermal expansion and contraction so as to conveniently assemble said second column portion 2 into said first column portion 1, when a temperature of assembled connecting rod returns to a normal temperature, an interference fit is formed between said first 1 and second 2 column portion. There are several different kinds of diameters and lengths of said connecting rod so as to meet different size of busbars or different size of said connecting portions 9.

What is claimed is:

1. A connecting rod comprising a conductive first column portion (1) that has an interference fit with a busbar, characterized in that said first column portion (1) axially arranging a conductive second column portion (2) which has an interference fit with said first column portion (1), said second column portion (2) being located inside of said first column portion (1), a thermal expansion coefficient of said second column portion (2) being greater than that of said first column portion (1); a resistivity of said second column portion (2) being greater than that of said first column portion (1), a material of said second column portion (2) being an aluminum or an aluminum alloy, and a material of said first column portion (1) being a copper or a copper alloy.

2. A connecting rod comprising a conductive first column portion (1) that has an interference fit with a busbar, characterized in that said first column portion (1) axially arranging a conductive second column portion (2) which has an interference fit with said first column portion (1), said second column portion (2) being located inside of said first column portion (1), a thermal expansion coefficient of said second column portion (2) being greater than that of said first column portion (1); a ratio of an outer diameter of said second column portion (2) to said first column portion (1) being between 0.5 and 0.8, said connecting rod axially arranging a second through hole (7) located inside of said connecting rod, a first through hole (6) being radially arranged to an outer cylindrical surface of said connecting rod, said first through hole (6) being communicated with said second through hole (7), said first through hole (6) being located at a middle portion of said connecting rod with respect to an axial direction.

* * * * *